US005415834A

United States Patent [19]

Finkl et al.

[11] Patent Number: 5,415,834

[45] Date of Patent: May 16, 1995

[54] WARM FORGING IMPLEMENT, COMPOSITION AND METHOD OF MANUFACTURE THEREOF

[75] Inventors: Charles W. Finkl, Evanston; Algirdas A. Underys, Arlington Heights, both of Ill.

[73] Assignee: A. Finkl & Sons Co., Chicago, Ill.

[21] Appl. No.: 183,491

[22] Filed: Jan. 19, 1994

[51] Int. Cl.[6] ..... C22C 38/46; C21C 7/10

[52] U.S. Cl. ..... 420/109; 148/335; 75/10.64; 75/508

[58] Field of Search ..... 420/109; 148/335; 75/508, 10.64

[56] References Cited

U.S. PATENT DOCUMENTS 3,501,289 3/1970 Finkl et al. ..... 75/508
5,252,120 10/1993 Finkl ..... 75/508

FOREIGN PATENT DOCUMENTS 56-44756 4/1981 Japan ..... 420/109
57-207158 12/1982 Japan ..... 420/109

*Primary Examiner*—Deborah Yee
*Attorney, Agent, or Firm*—Baker & McKenzie; James G. Staples

[57] ABSTRACT

A warm forging implement having high tensile strength, high abrasion resistance, high impact strength and high ductility and a composition within the following ranges:

| | |
|---|---|
| C | .28–.36 |
| Mn | .40–1.00 |
| P | Usual |
| S | Usual |
| Si | up to .35 |
| Ni | 1.65–3.40 |
| Cr | .80–1.30 |
| Mo | .40–1.00 |
| V | .05–.15 |

and a method of manufacture thereof which includes either single or double vacuum treatment, the second vacuum treatment being vacuum arc remelting.

11 Claims, 2 Drawing Sheets

WARM FORGING IMPLEMENT, COMPOSITION AND METHOD OF MANUFACTURE THEREOF

This invention relates generally to warm forging and specifically to implements used in the warm forging process and steel compositions especially adapted for warm forging operations, and methods of manufacturing warm forging implements.

BACKGROUND OF THE INVENTION

In recent years a new forging process known as warm forging has begun to evolve. It holds the promise of applying the well known advantages of conventional forging to applications for which conventional forging is considered too costly; specifically it appears highly likely that warm forging can be economically used to manufacture parts which are currently produced by casting and pressing techniques, both of which have been considered to be substantially less costly than conventional forging for many end applications.

It will be understood that the terms "hot forging", "warm forging" and "cold forging" are used in the shaping industry today. In the following description and claims, no reference will be made to "cold forging" which is essentially forging at room temperature, and the term "hot forging" will be used synonymously with "conventional forging".

Hot or conventional forging as currently practiced in the steel industry may be broadly described as the shaping of steel work pieces which have been heated, prior to shaping, to a temperature above the transformation temperature and which are then shaped, or formed, while at a temperature above the transformation temperature. Typical conventional forging temperatures of work pieces are in the range of 2200° F. to 2350° F., though in the majority of applications temperatures near the lower end of the range are employed.

Warm forging, in contrast, as currently practiced is carried out at temperatures below the transformation temperature. A typical warm forging temperature range as currently employed in the relatively small number of applications in which the technique is used may be on the order of from about 1400° F.–1800° F.

Warm forging has a number of advantages over conventional forging.

In warm forging up to about 98% of the metal work piece which is placed in the dies preparatory to forming is recovered in the forged part. As a consequence, far less post-forging operations, such as costly machining operations, must be performed on the work piece to bring it to its final desired size. This process of forging close to final required dimensions has been described as "precision forging" or "near net shape forging" or simply "near net" forging. This high utilization factor of warm forging is in contrast to conventional forging in which only about 70% of the material comprising the original work piece becomes the final product. As a consequence the approximately 30% of unutilized material in the work piece becomes "flash" which must either be disposed of or, more usually, is recycled by being sold back to steel makers at a small fraction, which may be on the order of about 10%, of its original cost. Hence warm forging results in a significant work piece material savings in both cost of work piece material required and subsequent scrap handling.

The fact that the resulting forging is closer to final size than the same work piece produced by conventional forging reduces the ultimate cost by eliminating all, or nearly all, of the post-forging special machining costs which are required in conventional forging to bring the work piece into specification.

Further, since the work piece is only heated to about 1500° F., as contrasted to the 2200°–2350° F. temperature used in conventional forging, a large energy saving results, not only on the basis of the final poundage of the forged product, but also on the basis of heat consumption of flashing.

Further, with respect to heat considerations, the problem of over heating of the work piece, or of the dies when a work piece becomes stuck therein, is substantially or entirely eliminated.

In addition, better surface quality is achieved by warm forging in many cases. In particular, warm forging results in less surface scale on the work piece. This decrease in surface scale results in better die life, cleaning forged work pieces, and less post forging clean up of the forged work piece.

The foregoing advantages do however put new demands on the forming equipment, and most particularly the forming dies or other components which come into direct contact with the work piece or are directly impacted thereby.

One of the more critical requirements is the dramatic increase in pressure, or probably more accurately, force applied to the die or other forming surfaces in warm forging as contrasted to conventional forging. It is for example, easier to shape a work piece having a temperature in the range of 2200° F.–2350° F. than the same work piece which is heated only into the range of 1400° F.–1800° F. The increased force required to shape the work piece in warm forging as contrasted to conventional forging requires that the material of which the warm forging die is composed be very strong to resist the forging forces, very resistant to abrasion, and have high ductility and impact strength to resist the forging loads which are characteristically applied at a high strain rate with greater frequency than are encountered in conventional forging.

SUMMARY OF THE INVENTION

Accordingly, objectives of this invention include the providing of a warm forging system and implements usable therein which have a long economic life, and steel compositions especially adapted for warm forging.

In one embodiment of the invention, a composition containing 0.28 to 0.36 C together with a carefully balanced quantity of Ni up to about 3.4% is utilized, either in a single or double vacuum processed condition, in the formation of a warm forging implement, hereafter referred to as a die.

BRIEF DESCRIPTION OF THE DRAWING

The invention is illustrated more or less diagrammatically in the accompanying Figures in which.

Near net shape, or warm, forging requires very restrictive flash lands around the impression in the die in order to fill the die cavity completely utilizing minimum forging stock. These restrictive flash lands increase the pressure, or forces in the die cavity dramatically over normal tolerance conventional forging, and this increased pressure is of course transmitted to the dies.

Another factor which results in increased forces in the die cavity is the higher resistance to plastic flow in the work piece which is inherent in warm forging as contrasted to conventional forging. This phenomena, when measured in terms of force required to deform the work piece at a given strain rate, is termed Flow Stress.

Figure 1:
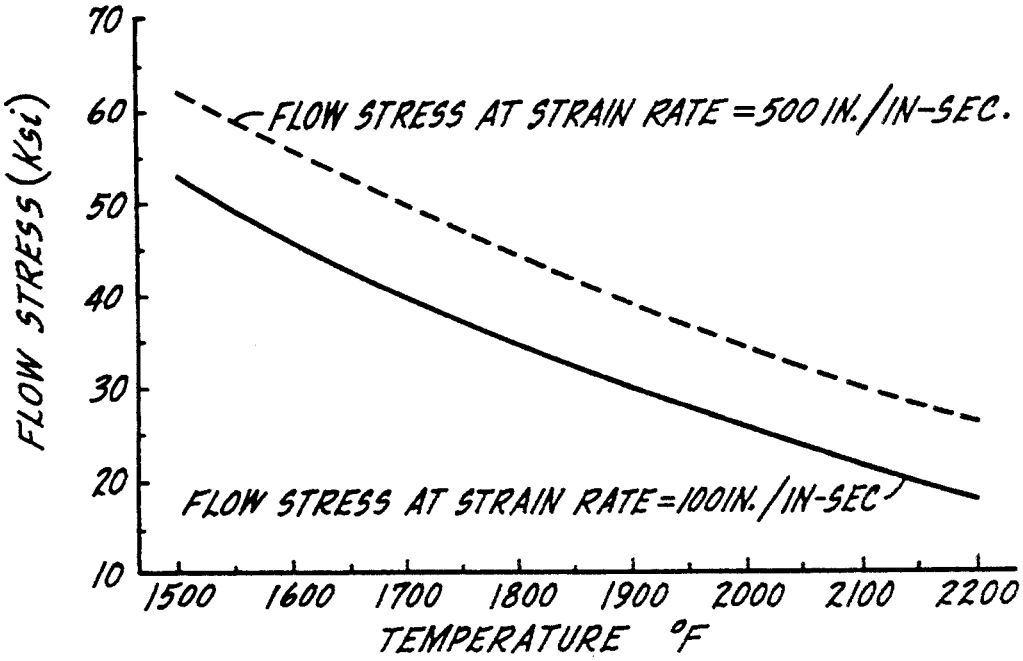
FIG. 1 is a comparison of Flow Stress at different strain rates versus temperature for a given steel.

FIG. 1 illustrates the relationship between Flow Stress and temperature. Two examples, one for a strain rate of 100 inches/inches-seconds and another for a strain rate of 500 inches/inches-seconds are illustrated. For purposes of understanding a description of one is sufficient. From the Figure it will be seen that with a decrease in temperature, there is an increase in the Flow Stress. Specifically, and referring to FIG. 1, at a temperature of 2200° F. the Flow Stress is about 20 ksi whereas when the temperature of the work piece drops to about 1450° F., the Flow Stress is about 57 ksi—almost three times as high. Thus, for a constant strain rate, much greater forces are generated in the work piece and in the die which is in contact with it during warm-forging, and hence the die must be more rugged than it need be if a conventional forging operation is to be carried out at 2200°-2350° F.

It will be understood that Flow Stress is a measure of a material's resistance to deformation. It can be described as the pressure required to sustain material flow in the absence of interface friction. The magnitude of Flow Stress of any forged material depends upon several factors, the most notable being the temperature of the material and the strain rate at which the material is deformed. The expression for Flow Stress is:

$$\text{Flow Stress} = C \times \textit{Strain Rate}^{m}$$

where:

C=strength coefficient (psi-sec)

m=strain rate sensitivity exponent

Strain Rate=die closing velocity/material thickness

The Flow Stress constants C and m are available for most forged materials and at several different forging temperatures within the hot forging range. These are available in several different publications, among which are "Flow Stress Data For Forged Alloys" published by FIERF, June/81, and "Flow Stress For Selected Forging Alloys At High Temperature and Strain Rates", published by FIERF February/86. (FIERF is the Forging Industry Education and Research Foundation, Cleveland, Ohio)

For example, AISI 1045 steel forged at 2010° F. has a strength coefficient C equal to 9900 psi-sec, and a strain rate sensitivity exponent m equal to 0.196. If the die closing velocity is equal to 25 inches per second, and the material thickness is equal to 0.25 inches, the strain rate would be equal to:

$$\frac{25 \text{ inches}}{\text{second}} \times \frac{1}{.25 \text{ inches}} = \frac{100}{\text{sec}}$$

The Flow Stress therefore is equal to:

$$9{,}900 \times 100.^{196} = 24{,}400 \textit{ psi}$$

Some typical effective velocities for forging equipment can be found in Table 1 and characteristic Flow Stress values for common forged materials can be found in Table 2.

As can be seen from Table 2, a given material forged at a high strain rate and low forging temperature can easily double the material's resistance to deformation.

TABLE 1

EFFECTIVE VELOCITIES OF FORGING EQUIPMENT

| Type of Forging Equipment | Effective Velocity (in/sec) |
|---|---|
| Gravity Hammers | 100 |
| Accelerated Blow Hammers | 150 |
| Screw Presses | 32 |
| Mechanical Presses | 40 |

TABLE 2

FLOW STRESS VALUES FOR TYPICAL MATERIALS - STEEL

| AISI MATERIAL DESIGNATION | TEMPERATURE (°F.) | STRAIN RATE (1/sec) | FLOW STRESS (psi) |
|---|---|---|---|
| 1045 | 1830 | 100 | 32,600 |
| | | 500 | 42,400 |
| | 2010 | 100 | 24,400 |
| | | 500 | 33,500 |
| | 2190 | 100 | 17,700 |
| | | 500 | 25,600 |
| 4130 | 1830 | 100 | 39,000 |
| | | 500 | 45,500 |
| | 2010 | 100 | 31,200 |
| | | 500 | 37,300 |
| | 2190 | 100 | 23,500 |
| | | 500 | 29,400 |
| 4340 | 1830 | 100 | 34,900 |
| | | 500 | 45,100 |
| | 2010 | 100 | 26,800 |
| | | 500 | 35,800 |
| | 2190 | 100 | 19,900 |
| | | 500 | 28,800 |
| 8620 | 1830 | 100 | 34,900 |
| | | 500 | 45,100 |
| | 2010 | 100 | 26,800 |
| | | 500 | 35,800 |
| | 2190 | 100 | 19,900 |
| | | 00 | 28,800 |

Precision or near net shape forging is usually a high production, automated process. Due to the high production volumes and the consequent cost of down time, die wear is a critical factor in overall die life and piece cost. Further, the processing equipment for precision forging subjects the die to repeated high pressure cycles that are applied over a short period of time, which equates to a high strain rate. Under these conditions, die breakage occurs due to low impact strength in the die and low ductility of the die material.

From the forgoing it can be seen that the requirements of successful warm forging, or near net precision forging die steel, include (a) high wear resistance, (b) high ductility and impact strength to resist the forging shock loads and (c) a high strength level to resist forging pressures.

Set out below are the broad, intermediate and preferred ranges of a die steel specially formulated for close tolerance warm forging.

| | Broad | Intermediate | Preferred |
|---|---|---|---|
| C | .28/.36 | .30/.36 | .31/.36 |
| Mn | .40/1.00 | .40/.65 | .40/.55 |
| P | usual | .010 max | .010 max |
| S | usual | .004 max | .004 MAX |
| Si | 0/.35 | .10/.35 | .15/.30 |
| Ni | 1.65/3.40 | 2.70/3.20 | 2.70/3.00 |
| Cr | .80/1.30 | .90/1.30 | 1.00/1.30 |
| Mo | .40/1.10 | .40/.80 | .65/.80 |
| V | .04/.20 | .06/.14 | .09/.14 |

A heat of the above steel having the following composition was prepared:

| | |
|---|---|
| C | .34 |
| Mn | .61 |
| P | .006 |
| S | .001 |
| Si | .21 |
| Ni | 3.20 |
| Cr | .98 |
| Mo | .48 |
| V | .09 |

After solidification three forged test coupons measuring 6"×21"×27" were prepared. All coupons were drastically quenched from the same temperatures, but the first was tempered at 1030° F., the second at 1100° F. and the third at 1200° F. The surface hardness of each was measured and physical properties were taken in a long transverse direction at ¼ height and ¼ depth. The test results are shown in FIGS. 2, 3 and 4.

Figure 2:
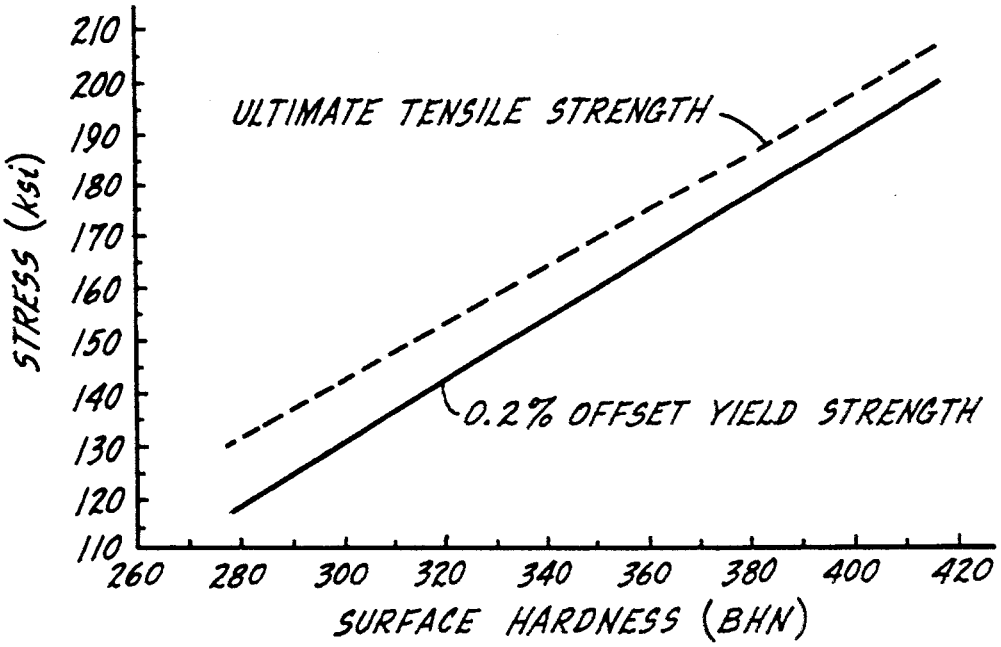
FIG. 2 is a comparison of strength versus hardness for an intermediate formulation of the composition included in the invention.

From FIG. 2 it will be noted that a BHN surface hardness of almost 420 was attainable, along with an ultimate tensile strength of almost 200 Ksi.

Figure 3:
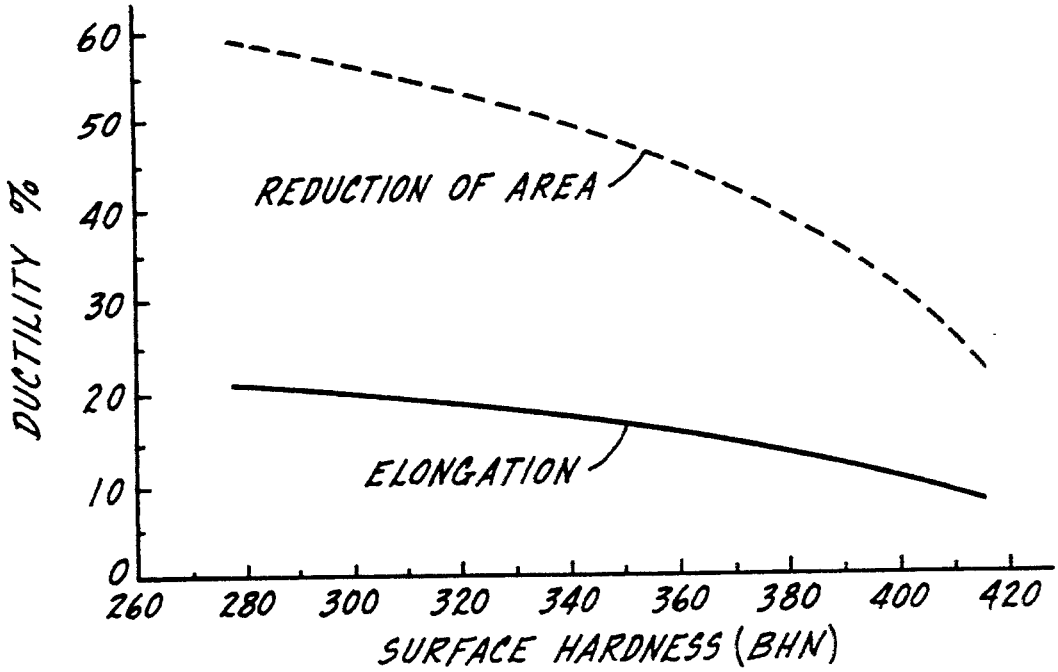
FIG. 3 is a comparison of ductility versus surface hardness for an intermediate formulation of the composition included in the invention.

From FIG. 3 it will be seen that with an increase in hardness the ductility as reflected in reduction of area and elongation values decreased, as would be expected. However, it will be noted that excellent ductility will be obtained even at hardness values approaching 420 BHN.

Figure 4:
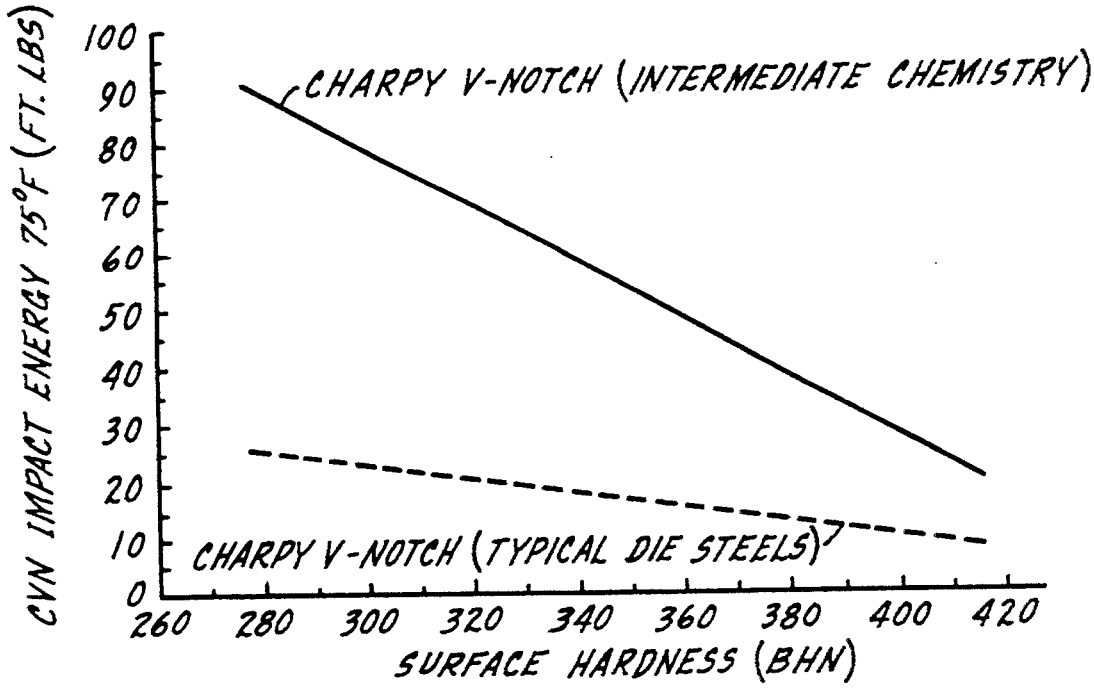
FIG. 4 is a comparison of impact strength versus surface hardness for an intermediate formulation of the composition included in the invention, and of a standard steel.

From FIG. 4 it Will be noted that the impact strength decreased with an increase in hardness, again as would be expected. However, the Figure discloses a dramatic improvement in impact strength of the invention composition as contrasted to a die steel having a 0.55 C, 1.0 Cr, 1.2 Ni, 0.4 Mo composition which is widely used in the industry today.

Another heat was prepared to the following chemistry:

| | |
|---|---|
| C | .33 |
| Mn | .51 |
| P | .007 |
| S | .004 |
| Si | .30 |
| Ni | 2.88 |
| Cr | 1.05 |
| Mo | .45 |
| V | .07 |

The resulting steel was commercially forged for an especially difficult close tolerance warm forging application. The steel was heat treated to maximum hardness achievable, 415 BHN, which is approximately 44 HRc. In use the die material performed satisfactorily, though it was concluded that some increase in wear resistance would be beneficial.

A preferred formulation is as follows:

Carbon should be left at approximately 0.33 for toughness and ductility. Raising carbon increases the amount of retained austenite and lowers the temperature that martensite transformation occurs (making it harder to achieve in typical industrial heat treating operations) A drastic quench such as a water quench, enhances the formation of martensite. Before the die can be used, however, it must be tempered to increase ductility and toughness. Tempered martensite will posses the best combination of physical properties. Lower carbon is also beneficial if a weld overlay of an extremely hard material is desired.

Manganese is preferred to be present at the lower end of the intermediate range; higher manganese lowers the temperature of transformation to martensite.

Phosphorus and sulfur should be at low levels to promote cleanliness and good physical properties.

Silicon is preferred at mid-range; it acts as a deoxidizer and confers a modest resistance to tempering.

Nickel is preferred to be present in the lower to bottom of the intermediate range. While improving toughness, nickel increases the amount of retained austenite. If the austenite decomposes to un-tempered martensite during use as a forging die, a hard brittle phase may develop that can lead to catastrophic die failure.

Chromium should be present at the high end of the intermediate range. Cr imparts hardenability and increased wear resistance through the formation of chromium carbides.

Molybdenum should be present at the high end of the intermediate range. Mo increases hardenability and reduces the possibility of temper embrittlement (especially important if die steel is tempered at low temperatures to achieve high strength levels and hardness). It is a strong carbide former that will improve wear resistance and is the most important element in achieving high hardness without sacrificing physical properties due to secondary hardening peak.

Vanadium is present in the mid-range of intermediate chemistry. Vanadium is used primarily for grain size control. Vanadium increases the temper resistance of the material. Vanadium is a strong carbide former that will improve the wear resistance of the material.

Preferably the material is treated in accordance with the processing disclosed in U.S. Pat. No. 3,501,289, the disclosure of which is incorporated herein by reference. Essentially, electric furnace melted steel is, following tap, initially subjected to the combined effect of subjection to a vacuum effective to remove H in combination with the upward passage of a purging gas in a vacuum tank or equivalent environment. Thereafter the heat may be subjected to the combined effect of vacuum, a purging gas, and heating by an alternating current heating arc, the process being so adjusted as to be not adversely affected by such now well known phenomena as the glow range.

Alternatively, and thereafter following treatment as above described, the heat may be subjected to vacuum arc remelting by the processing disclosed in U.S. Pat. No. 5,252,120, the disclosure of which is incorporated herein by reference. If material is to be vacuum arc remelted the amount of manganese will be chemically adjusted initially to a high level, for example 0.80–0.95, to allow for losses in the VAR process. The resulting manganese with this starting level would be approximately 0.40–0.65 (intermediate range manganese). VAR will improve the transverse physical properties of the material including impact, toughness and ductility. A double vacuum process may be required when the material is at the maximum achievable hardness (approximately 450 BHN) for wear resistance, and additional and ductility is required.

From the foregoing it will be observed that preferred embodiments of the invention have been illustrated and described. It is intended however that the scope of the invention be limited not by the foregoing description, but solely by the scope of the hereafter appended claims when interpreted in light of the relevant prior art.

We claim:

1. A warm forging implement, said warm forging implement having, or having the capability of having, a yield strength of up to about 225 Ksi at a hardness of approximately 444 BHN, high ductility, measured as reduction of area, of about 25%–30% at approximately 415 BHN, and high impact strength, measured by the Charpy V notch method, of about 20–25 ft-lbs at approximately 415 BHN, said implement having the following approximate composition in weight percent:

| | |
|---|---|
| C | .28–36 |
| Mn | .40–1.0 |
| P | usual |
| S | usual |
| Si | up to .35 |
| Ni | 1.65–3.40 |
| Cr | .80–1.30 |
| Mo | .10–1.0 |
| V | .05–.15 |

balance Fe with usual incidental impurities, said implement being in a forged condition, said composition, prior to forging, having been subjected to the effect of subjection to vacuum at an absolute presence sufficiently low to significantly decrease the included hydrogen from its level in its as melted condition, and the upward passage of a purging gas.

2. The warm forging implement of claim 1 further characterized in that said composition, prior to forging is subjected to the aforesaid vacuum and purging gas simultaneously.

3. The warm forging implement of claim 2 further characterized in that said implement, prior to forging and subsequent to the aforesaid vacuum and purging gas treatment and solidification, is remelted by the vacuum arc remelt method.

4. A forging implement, said forging implement having high yield strength, high ductility, high impact strength and high hardness and the following approximate composition in weight percent:

| | |
|---|---|
| C | .28–36 |
| Mn | .40–1.0 |
| P | usual |
| S | usual |
| Si | up to .35 |
| Ni | 1.65–3.40 |
| Cr | .80–1.30 |
| Mo | .10–1.0 |
| V | .05–.15 |

balance Fe with usual incidental impurities.

5. The forging implement of claim 4 further characterized in that, the approximate composition in weight percent is:

| | |
|---|---|
| C | .30–.36 |
| Mn | .40–.65 |
| P | .010 max |
| S | .004 max |
| Si | 0–.35 |
| Ni | 2.70–3.20 |
| Cr | .90–1.30 |
| Mo | .40–.80 |
| V | .06–.14 |

balance Fe with usual incidental impurities.

6. The forging implement of claim 4 further characterized in that, the approximate composition in weight percent is:

| | |
|---|---|
| C | .31–.36 |
| Mn | .40–.55 |
| P | .010 max |
| S | .004 max |
| Si | .15–.30 |
| Ni | 2.70–3.00 |
| Cr | 1.00–1.30 |
| Mo | .65–.80 |
| V | .09–.14 |

balance Fe with usual incidental impurities.

7. A steel composition, said steel composition having the following approximate composition in weight percent:

| | |
|---|---|
| C | .33 |
| Mn | .48 |
| P | .010 |
| S | .004 |
| Si | .23 |
| Ni | 2.85 |
| Cr | 1.13 |
| Mo | .73 |
| V | .11 |

balance Fe with usual incidental impurities.

8. A method of making a warm forging implement, said method including the steps of preparing a heat having the following approximate composition:

| | |
|---|---|
| C | .28–.36 |
| Mn | .40–1.00 |
| P | usual |
| S | usual |
| Si | up to .35 |
| Ni | 1.65–3.40 |
| Cr | .80–1.30 |
| Mo | .40–1.00 |
| V | .05–.15 |

balance Fe with usual incidental impurities, subjecting the heat in its molten condition to the simultaneous effect of (i) a vacuum at an absolute pressure sufficiently low to significantly decrease the included hydrogen from its level in its as melted condition (ii) and the upward passage of a purging gas during at least a portion of the time the heat is subjected to vacuum, and thereafter solidifying and forging the solidified steel.

9. The method of claim 8 further included the steps, of subsequent to vacuum and purging treatment, solidifying the aforesaid treated steel, converting said solidified steel into a shape adapted for vacuum arc remelting, vacuum arc remelting the said solid shape, and thereafter forging and machining, if required, the resultant vacuum arc remelted ingot into a warm forging implement.

10. The method of claim 9 further characterized in that, the Mn content of the steel in its pre-vacuum arc remelt condition is approximately twice the manganese content desired in the vacuum arc remelted ingot.

11. The method of claim 8 further characterized in that following solidification the steel is subjected to a drastic quench.

* * * * *